US008534783B2

(12) United States Patent
Nash et al.

(10) Patent No.: US 8,534,783 B2
(45) Date of Patent: Sep. 17, 2013

(54) SHELF ASSEMBLY WITH A SINGLE-PIECE FRAME PARTICULARLY SUITED FOR USE IN A REFRIGERATION APPLIANCE

(75) Inventors: Jonathan Ian Nash, La Grange, KY (US); Donald Joseph Breit, Louisville, KY (US)

(73) Assignee: General Electric Company, Schenectady, NY (US)

( * ) Notice: Subject to any disclaimer, the term of this patent is extended or adjusted under 35 U.S.C. 154(b) by 405 days.

(21) Appl. No.: 12/912,946

(22) Filed: Oct. 27, 2010

(65) Prior Publication Data

US 2012/0104924 A1 May 3, 2012

(51) Int. Cl.
*A47B 96/04* (2006.01)
*A47B 9/00* (2006.01)

(52) U.S. Cl.
USPC ..... 312/408; 108/108

(58) Field of Classification Search
USPC ..... 312/404, 408, 351, 296; 108/106–108
See application file for complete search history.

(56) References Cited

U.S. PATENT DOCUMENTS

| | | | | |
|---|---|---|---|---|
| 4,757,909 | A * | 7/1988 | Matsuura | 220/7 |
| 4,934,541 | A * | 6/1990 | Bussan et al. | 211/153 |
| 5,403,084 | A | 4/1995 | Kane et al. | |
| 5,429,433 | A | 7/1995 | Bird et al. | |
| 5,516,204 | A | 5/1996 | Calvert et al. | |
| 5,524,981 | A | 6/1996 | Herrmann et al. | |
| 5,677,030 | A | 10/1997 | Shanok et al. | |
| 6,045,101 | A * | 4/2000 | Goyette et al. | 248/235 |
| 6,105,233 | A * | 8/2000 | Neal | 29/451 |
| 6,520,353 | B2 * | 2/2003 | Fulbright | 211/153 |
| 6,729,704 | B2 | 5/2004 | Ames | |
| 7,028,725 | B2 | 4/2006 | Hooker | |
| 7,270,385 | B2 | 9/2007 | Mathur et al. | |
| 7,306,304 | B2 * | 12/2007 | Jang | 312/408 |
| 7,401,489 | B2 * | 7/2008 | Wing | 72/379.2 |
| 7,426,838 | B1 | 9/2008 | Shapiro et al. | |
| 2003/0222043 | A1 * | 12/2003 | Rouch et al. | 211/153 |
| 2004/0084464 | A1 * | 5/2004 | Koo | 220/784 |
| 2006/0145577 | A1 * | 7/2006 | Daley et al. | 312/408 |
| 2011/0115356 | A1 * | 5/2011 | Nash et al. | 312/408 |

FOREIGN PATENT DOCUMENTS

EP 942245 A2 * 9/1999

* cited by examiner

*Primary Examiner* — Janet M Wilkens
*Assistant Examiner* — Andrew Roersma
(74) *Attorney, Agent, or Firm* — Dority & Manning, P.A.

(57) ABSTRACT

A shelf assembly includes a shelf pane having perimeter edges. A single-piece frame structure is fitted around the perimeter of the shelf pane. The frame structure includes a unitary upper frame member that extends inwardly from the pane edges along a top surface of the shelf pane. A respective lower frame member is connected to the upper frame member along each edge of the shelf pane and is pivotally configured with the upper frame member. The lower frame members are folded under and extend inwardly along a bottom surface of the shelf pane. An attachment mechanism is configured between the respective lower frame members and the upper frame member outward of the edges of the shelf pane.

18 Claims, 4 Drawing Sheets

SHELF ASSEMBLY WITH A SINGLE-PIECE FRAME PARTICULARLY SUITED FOR USE IN A REFRIGERATION APPLIANCE

FIELD OF THE INVENTION

The present subject matter relates generally to a shelf configuration, and more particularly to a spill-proof refrigerator shelf.

BACKGROUND OF THE INVENTION

A refrigerator typically includes a number of shelves for the storage of food and beverage containers of many shapes and sizes. As the containers are retrieved, returned and/or rearranged on the shelves, occasional leaks and spilling of food and liquid may occur. Cleaning up after a spill on a crowded refrigerator shelf can be difficult, especially when spilled liquid leaks onto lower shelves.

To contain liquid spills on a refrigerator shelf, it is known to use "picture frame" shelves that include edges wrapped around, attached, or otherwise fitted to a glass plate to form a dam around the edges of the plate for containing spilled liquid. Reference is made, for example to U.S. Pat. No. 5,677,030, which describes a continuous edge trim that wraps around the peripheral edge of a glass shelf and extends above the glass to form a spill-proof dam. The trim piece has a substantially "F" shaped cross-sectional profile, with the glass sliding into the "U" chamber defined by the upper and lower arms. U.S. Pat. Nos. 5,429,433; 5,524,981; and 5,403,084 describe refrigerator shelves having a rim directly molded around the entire perimeter edge of the shelf member. Frame assemblies are also known that include separate upper and lower frame members, with the glass pane sandwiched between the frame members.

The conventional picture frame shelf assemblies have certain disadvantages from a production and/or cost perspective, or in terms of performance. For example, the insert molding (glass encapsulation) processes may depend on shrinkage of the plastic used to fabricate the frame, which requires the edges of the glass plate to be notched for the frame to properly seal the glass. The frames formed from separate frame members require multiple tools to form the frame members.

Accordingly, it would be desirable to provide a spill-proof shelf assembly that is reliable, is not dependent on variances between the glass shelf dimensions and/or shrinkage of the frame members, and is commercially feasible to produce.

BRIEF DESCRIPTION OF THE INVENTION

Aspects and advantages of the invention will be set forth in part in the following description, or may be obvious from the description, or may be learned through practice of the invention.

In an exemplary embodiment, a shelf assembly is provided that is particularly suited for use in a refrigeration appliance, such as a refrigerator, freezer, and the like. The shelf assembly includes a pane having perimeter edges. The pane is encased in a single-piece frame structure fitted around the perimeter of the pane. The frame structure has a unitary upper frame member extending inwardly from the pane edges along a top surface of the pane. The frame structure includes a plurality of lower frame members, with a respective lower frame member connected to the upper frame member along each edge of the pane. The lower frame members are pivotally configured with the upper frame member and are folded under the upper frame member so as to extend inwardly along a bottom surface of the pane. A suitable attachment mechanism is configured between the lower frame members and the upper frame member outward of the pane edges. Thus, the pane is essentially clamped between the upper frame member and the lower frame members along the edges of the pane.

In another exemplary embodiment, a pull-out refrigeration appliance shelf assembly includes a pane having a perimeter defined by side edges, a front edge, and a back edge. A single-piece frame structure is fitted around the perimeter of the pane and includes a unitary upper frame member in which the pane is seated. The upper frame member has a flange portion that extends inwardly from the pane edges along a top surface of the pane. The pane is positively located and seated in the upper frame member by means of shoulders that extend from an underside of the upper frame member and engage against the edges of the pane. A respective lower frame member is pivotally connected to the upper frame member with a living hinge along each edge of the pane. The lower frame members are folded under the upper frame member around the pane edges and extend inwardly along a bottom surface of the pane. The lower frame members are fastened to the upper frame member outward of the pane edges.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
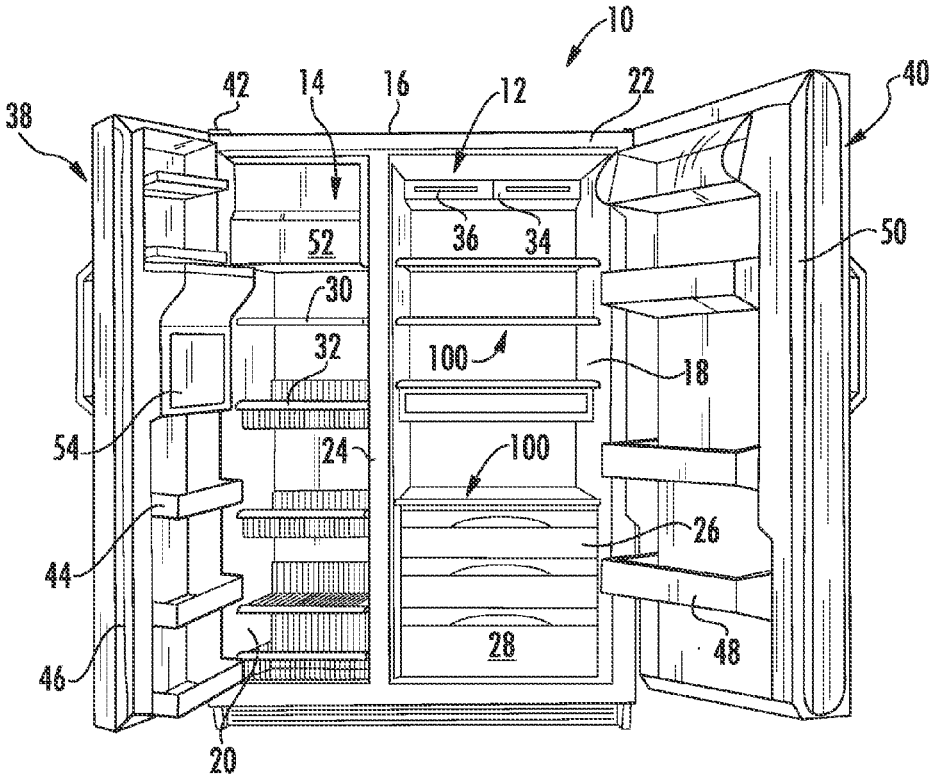
FIG. 1 is a perspective view of a refrigeration appliance, in particular a refrigerator, incorporating one or more shelf assemblies in accordance with aspects of the invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of an exemplary refrigeration appliance 10 depicted as a refrigerator in which shelf assemblies in accordance with aspects of the present invention may be utilized. It should be appreciated that the appliance of FIG. 1 is for illustrative purposes only and that the present invention is not limited to any particular type, style, or configuration of refrigeration appliance, and that such appliance may include any manner of refrigerator, freezer, refrigerator/freezer combination, and so forth.

Referring to FIG. 1, the refrigerator 10 includes a fresh food storage compartment 12 and a freezer storage compartment 14, with the compartments arranged side-by-side and contained within an outer case 16 and inner liners 18 and 20 generally molded from a suitable plastic material. In smaller refrigerators 10, a single liner is formed and a mullion spans between opposite sides of the liner to divide it into a freezer storage compartment and a fresh food storage compartment. The outer case 16 is normally formed by folding a sheet of a suitable material, such as pre-painted steel, into an inverted U-shape to form top and side walls of the outer case 16. A bottom wall of the outer case 16 normally is formed separately and attached to the case side walls and to a bottom frame that provides support for refrigerator 10.

A breaker strip 22 extends between a case front flange and outer front edges of inner liners 18 and 20. The breaker strip 22 is formed from a suitable resilient material, such as an extruded acrylo-butadiene-styrene based material (commonly referred to as ABS). The insulation in the space between inner liners 18 and 20 is covered by another strip of suitable resilient material, which also commonly is referred to as a mullion 24 and may be formed of an extruded ABS material. Breaker strip 22 and mullion 24 form a front face, and extend completely around inner peripheral edges of the outer case 16 and vertically between inner liners 18 and 20.

Shelves 100, slide-out drawers 26, and a storage bin 28 are normally provided in fresh food storage compartment 12 to support items being stored therein. The shelves 100 are described in greater detail below. In addition, at least one shelf 30 and at least one wire basket 32 are also provided in freezer storage compartment 14.

The refrigerator features are controlled by a controller 34 according to user preference via manipulation of a control interface 36 mounted in an upper region of fresh food storage compartment 12 and coupled to the controller 34. As used herein, the term "controller" is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein. The controller 34 may also be an electromechanical device.

A freezer door 38 and a fresh food door 40 close access openings to freezer storage compartment 14 and fresh food storage compartment 12. Each door 38, 40 is mounted by a top hinge 42 and a bottom hinge (not shown) to rotate about its outer vertical edge between an open position, as shown in FIG. 1, and a closed position. The freezer door 38 may include a plurality of storage shelves 44 and a sealing gasket 46, and fresh food door 40 also includes a plurality of storage shelves 48 and a sealing gasket 50.

The freezer storage compartment 14 may include an automatic ice maker 52 and a dispenser 54, provided in the freezer door 38 such that ice and/or chilled water can be dispensed without opening the freezer door 38, as is well known in the art.

As with known refrigerators, the refrigerator 10 also includes a machinery compartment (not shown) that at least partially contains components for executing a known vapor compression cycle for cooling air. The components include a compressor, a condenser, an expansion device, and an evaporator connected in series and charged with a refrigerant. The evaporator is a type of heat exchanger which transfers heat from air passing over the evaporator to the refrigerant flowing through the evaporator, thereby causing the refrigerant to vaporize. The cooled air is used to refrigerate one or more refrigerator or freezer compartments via fans. Collectively, the vapor compression cycle components in a refrigeration circuit, associated fans, and associated compartments are conventionally referred to as a sealed system. The construction and operation of the sealed system are well known to those skilled in the art.

Figure 2:
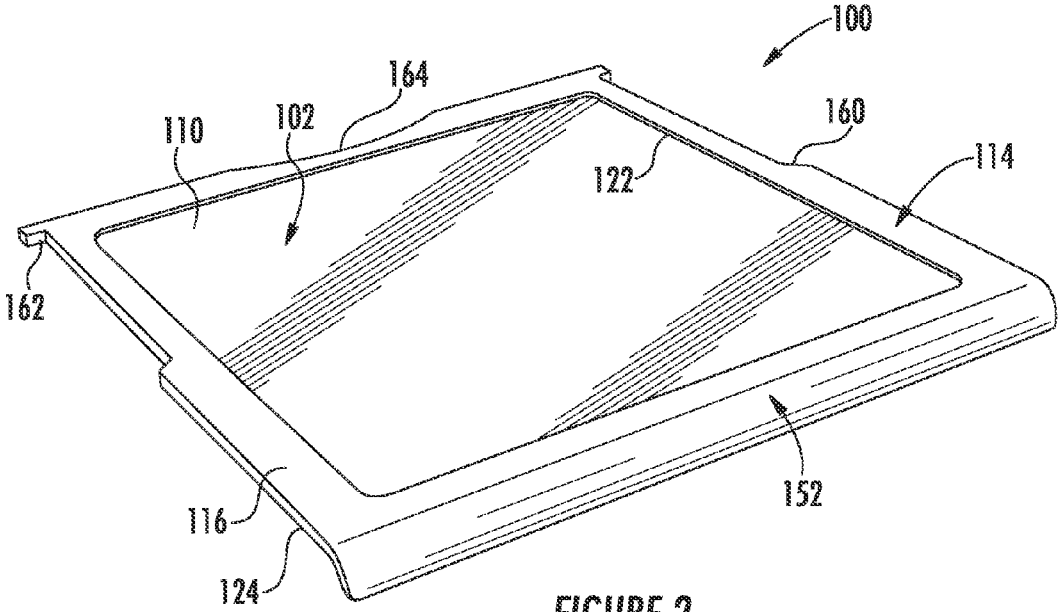
FIG. 2 is a perspective view of a shelf assembly.
Figure 6:
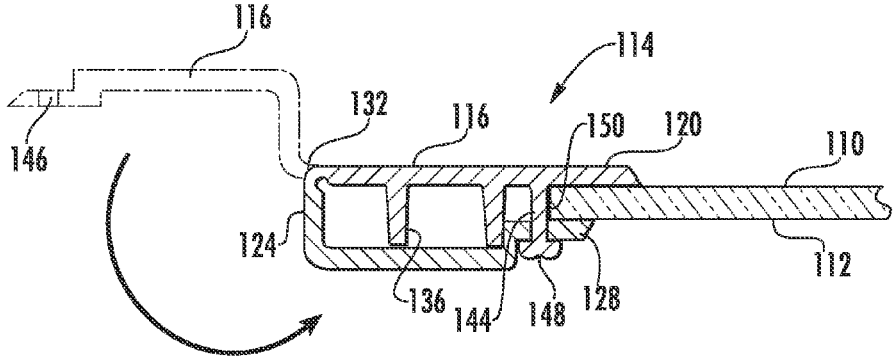
FIG. 6 is a cross-sectional and partial operational view of a particular embodiment of a frame structure.

FIG. 2 depicts an embodiment of a shelf assembly 100 that incorporates aspects of the invention and may be used in the refrigerator 10 depicted in FIG. 1, or in any other type of refrigeration appliance. Although the shelf assembly 100 is particularly suited for use in a refrigeration appliance, it should be appreciated that the shelf assembly 100 is not limited to such use and may have utility in any type of storage device or compartment wherein a spill-proof shelf having the attributes of the present invention is desired. The shelf assembly 100 includes a shelf pane 102, which is typically formed from glass or any other suitable material, such as a clear plastic material. The pane 102 has edges 104 that define a perimeter of the pane 102. The pane 102 includes a top surface 110 and a bottom surface 112 (FIG. 6).

The shelf assembly 100 includes a single-piece frame structure 114 that is fitted around the perimeter of the shelf pane 102. The frame structure 114 is "single-piece" in that it does not comprise multiple components that are assembled or separately fitted together around the pane 102, but is a single unitary member that encases the edges 104 of the pane 102, as described in greater detail below.

In a particular embodiment, the frame structure 114 is molded from a plastic material having characteristics suitable for use in the environment of the shelf assembly 100. For example, the frame structure 114 may be fabricated from a talc-filled polypropylene, acrylonitrile-butadine-styrene (ABS), or high-impact polystyrene (HIPS). Other suitable materials may also be used.

Referring to FIGS. 2 through 5 in particular, the single-piece frame structure 114 includes a unitary upper frame member 116 that extends inwardly from edges 104 along the top surface 110 of the pane 102 and outwardly beyond the edges 104. In particular, the upper frame member 116 may include a flange portion 120 that extends onto the top surface 110. The flange 120 may terminate at an end that creates a dam 122 to fluids that may be spilled onto the top surface 110. Other portions of the upper frame member 116 may extend outwardly beyond the edges 104 of the pane 102, as described in greater detail below.

Figure 7:
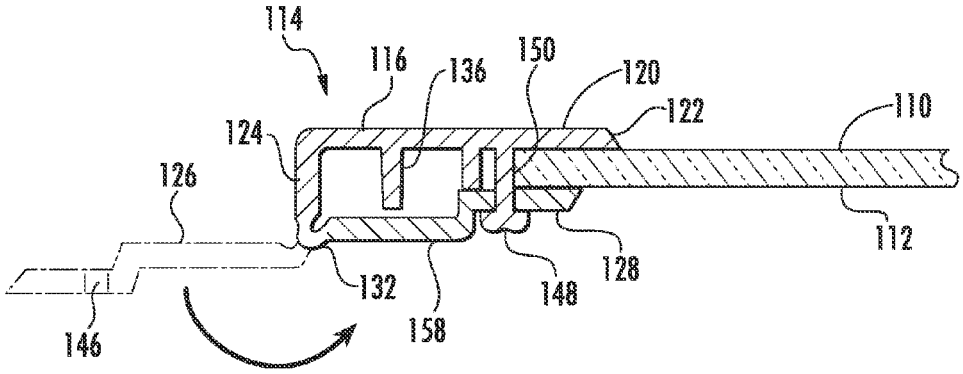
FIG. 7 is a cross-sectional and partial operational view of another embodiment of a frame structure.
Figure 8:
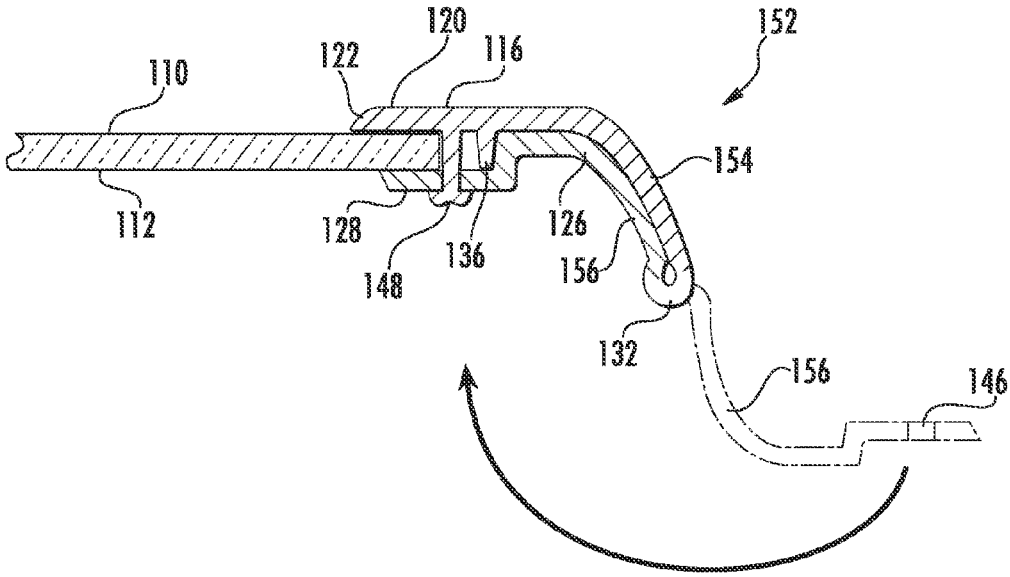
FIG. 8 is a cross-sectional and partial operational view of an embodiment of a front edge of a frame structure.

The frame structure 114 includes a plurality of lower frame members 126, with at least one of the lower frame members 126 connected to a respective side of the upper frame member 116 along one of the pane edges 104. The lower frame members 126 are pivotally configured with the upper frame member 116 at a hinge line 130 and are folded at the hinge line 130 so as to extend under and inwardly along a bottom surface 112 of the pane 102. In the illustrated embodiment, the lower frame members 126 include a flange portion 128 that engages against the bottom surface 112 of the pane 102, as particularly illustrated in FIGS. 6 and 7. Other portions of the lower frame member 126 extend outwardly beyond the edges 104 of the pane 102.

The single-piece frame structure 114 may be formed from separate frame members 116, 126 that are subsequently joined along the hinge line 130. For example, a plurality of lower frame member components may be ultra-sonically welded to the upper frame member 116 along respective hinge lines 130.

The frame members 116, 126 may include any manner of additional structure formed therewith or attached thereto. For example, attachment devices can be provided to attach track brackets for a cant track shelf support. Also, the frame members may be configured for receipt of any manner of component associated with a slide system for sliding the shelf assembly 100 into or out of the refrigerator compartment.

A suitable attachment mechanism 138 is configured between the lower frame members 126 and the upper frame member 116 along each edge 104 of the pane 102. The attachment mechanism 138 is configured between the portions of the frame members 116, 126 that extend outward beyond the edges 104. In a particular embodiment illustrated in the figures, the attachment mechanism 138 is defined by a male member configured on one of the frame members that engages with a female member configured on the other respective frame member. For example, referring to FIGS. 4 and 5 in particular, the male component of the attachment mechanism 138 is defined by a tab 144. The female component is defined by a slot 146 defined in the lower frame member 126. When the lower frame member 126 is folded under the pane 102, the tabs 144 engage through the slots 146, as particularly illustrated in FIGS. 4 and 5. The tabs 144 are subsequently capped, for example in a heat-stake process wherein a cap 148 is permanently formed on the portion of the tabs 144 that extend through the slots 146. Alternatively, any other suitable means may be utilized to ensure that the tabs 144 do not pull out from the slots 146. In the illustrated embodiment, a plurality of the tabs 144 and slots 146 are configured along each side of the frame structure 114.

In a particular embodiment illustrated in the figures, the hinge line 130 is defined by a living hinge 132 that connects the lower frame members 126 with the upper frame member 116. The living hinge 132 may be defined by a thinned or weakened area of the plastic material along the hinge line 132. In an alternate embodiment, the living hinge 132 may be defined by a flexible strip of material that is co-molded with the frame members 116, 126 along the hinge lines 130, or otherwise attached to the frame members.

Figure 3:
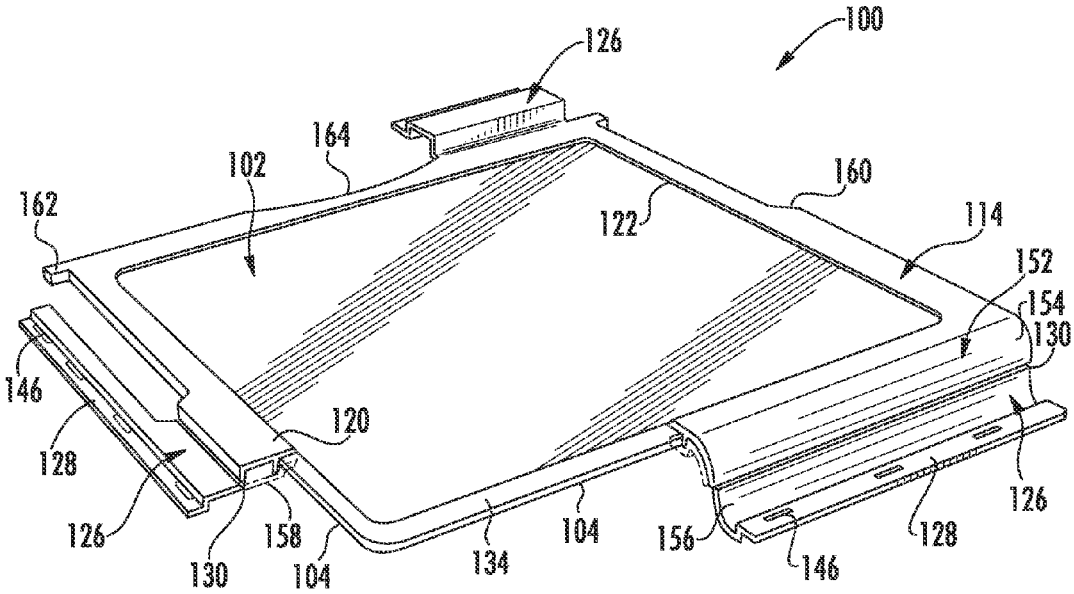
FIG. 3 is a perspective and partial cut-away view of the shelf assembly of FIG. 2.
Figure 4:
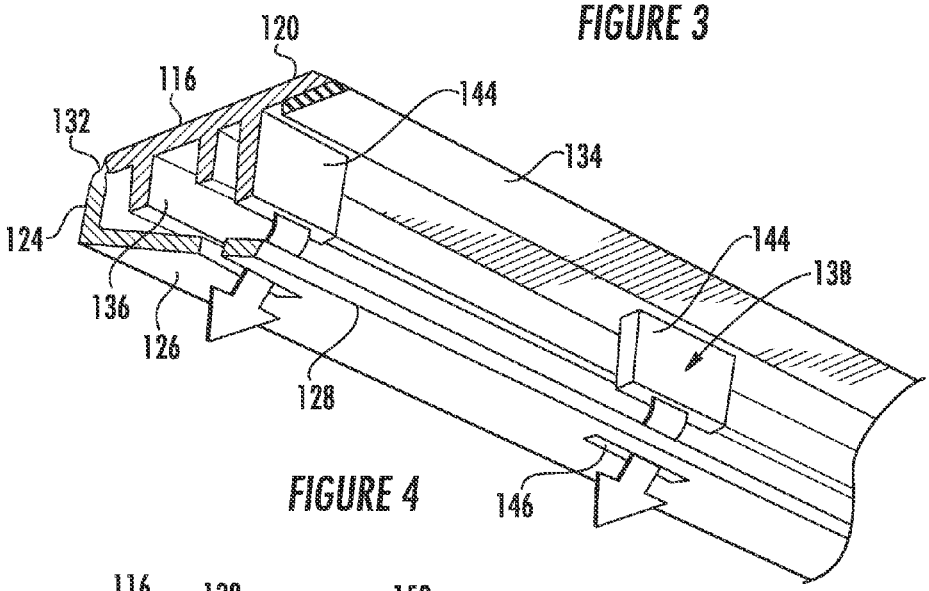
FIG. 4 is a perspective view of an embodiment of the upper and lower frame members of the shelf assembly.
Figure 5:
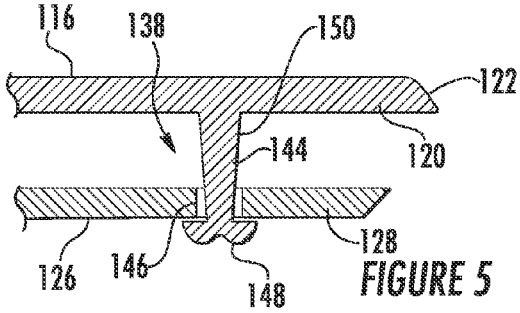
FIG. 5 is a cross-sectional view of an embodiment of an attachment mechanism between the upper and lower frame members.

Desirably, a gasket material 134 is sandwiched between the top surface 110 of the pane 102 and the flange 120 of the upper frame member 116. In the embodiment of FIG. 3, the gasket material 134 may be a strip of sealing material that is applied on the top surface 110 prior to installation of the frame structure 114 around the pane 102. In an alternative embodiment illustrated in FIG. 4, the gasket material 134 is a strip of material that is a component of the upper frame member 116. For example, the gasket material 134 may be co-molded with the flange 120. In an alternative embodiment, the gasket material 134 may be pre-applied to the pane 102, for example in a hot-stamping process. The gasket material 134 may be a bead of material, such as silicon, that is applied to the pane 102 or upper frame member 116. It should also be appreciated that the invention is not limited to any particular type of gasket material 134. TPE (Thermoplastic Elastomer) and TPO (Thermoplastic Polyolefin) are suitable materials, as well as a number of other moldable resilient materials. Compression or performance of the gasket material 134 produces the spill-proof characteristic of the shelf assembly 100. "Spill-proof" is generally recognized in the art as the ability of the shelf to retain twelve oz. of fluid for at least twenty-four hours. Lesser performance is generally referred to as "spill-resistant."

In alternative embodiments, the gasket material 134 may be replaced by, or augmented with, a hydrophobic coating applied around the perimeter of the pane 102.

As particularly seen in FIGS. 4 through 8, one or more reinforcing ribs 136 may extend between the upper frame member 116 and the lower frame member 126 in the portion of the frame members that is outward of the pane edges 104. These reinforcing ribs 136 provide a desired degree of structural integrity to the frame structure 114 to ensure that the shelf assembly 100 can carry the designed load and be supported by brackets or other support structure within the appliance 10.

In order to positively seat the pane 102 within the frame structure 114 during construction of the shelf assembly 100, positioning shoulders 150 may be provided around the perimeter of the frame structure 114. In the illustrated embodiment, the shoulders 150 are defined by the tabs 144 that also function as components of the attachment mechanism 138. For example, as seen in FIGS. 3 and 6 through 8, the edges 104 of the pane 102 engage against the tabs 144 that extend downwardly from the upper frame member 116. Thus, to assembly the shelf 100, the frame structure 114 is placed on a support surface with the upper frame member 116 facing down and the lower frame members 126 folded outward. The shelf pane 102 is then placed into the upper frame member 116 so as to be seated within the tabs 144 and engaged against the shoulders 150. The lower frame members 126 are then folded over onto the back surface 112 of the pane 102 and permanently attached to the upper frame member 116 with any manner of suitable attachment mechanism 138 as described above.

In a unique embodiment, the shelf assembly 100 is configured as a pull-out shelf that can be slid into and out of the refrigerator 10 or other appliance. For this purpose, a curved pull-out handle 152 may be configured at the front edge of the pane 102 by the frame structure 114. For example, referring to FIGS. 3 and 8, the pull-out handle 152 may be formed by a curved extension 154 of the upper frame member 116 that mates with a curved extension portion 156 of the lower frame member 126. The living hinge 132 may be defined between the curved extensions 154, 156.

The frame structure 114 may further define a slide surface to facilitate movement of the shelf assembly 100 into and out of the refrigerator 10, for example along ledges defined in the liners 18, 20 (FIG. 1). In the illustrated embodiment, a slide surface 158 is defined by the frame structure 114 forward of an offset 160 defined along the sides of the shelf assembly 100, as particularly illustrated in FIGS. 2 and 3. The slide surface 158 is defined on the portion of the lower frame member 126 that extends outward beyond the pane edges 104 forward of the offset 160. A stop 162 is defined by the frame structure 114 along the back edge of the shelf assembly 100. The stop 162 engages against the support structure in the refrigerator 10 to prevent inadvertent pulling of the shelf 100 completely out of the refrigerator 10. The offset 160 defines a portion of reduced width dimensions along the sides of the shelf assembly 100 rearward of the offset 160 for vertical air flow along the shelf assembly 100. Similarly, a cutout or reduced width section 164 is defined along the back edge of the frame structure 114 between respective lower frame members 126 configured on opposite sides of the cutout section 164. The cutout section 164 also defines an airflow passage along the back edges of the shelf assembly 100. The airflow passages along the sides and back edges of the shelf assembly 100 ensure even cooling airflow around the shelves when the shelves are placed within the refrigerator 10.

It should be appreciated that the frame structure 114 may have various configurations within the scope and spirit of the invention. For example, in the embodiment illustrated in FIG. 6, the side wall 124 of the frame structure 114 is defined as a component of the lower frame member 126, with the living hinge 132 defined between the side wall 124 and the upper frame member 116. In the embodiment illustrated in FIG. 7, the side wall 124 is configured as a component of the upper frame member 116, with the living hinge 132 configured between the side wall 124 and the lower frame member 126.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A shelf assembly particularly suited for use in a refrigeration appliance, comprising:

a shelf pane having at least three edges defining a perimeter of said shelf pane;

a single-piece frame structure fitted around said perimeter of said shelf pane, said frame structure further comprising:

a unitary upper frame member extending inwardly from said edges along a top surface of said shelf pane;

a plurality of lower frame members, each lower frame member of said lower frame members pivotally connected to said upper frame member at a respective one of the at least three edges of said shelf pane such that the at least three edges of said shelf pane each have at least one of said plurality of lower frame members positioned thereat, said lower frame members pivotally configured with said upper frame member and folded under and extending inwardly along a bottom surface of said shelf pane; and an attachment mechanism configured between said lower frame members and said upper frame member outward of said edges of said shelf pane.

2. The shelf assembly as in claim 1, further comprising a living hinge formed between said lower frame members and said upper frame member.

3. The shelf assembly as in claim 1, further comprising a gasket material configured on an underside of said upper frame member that seals against said top surface of said shelf pane.

4. The shelf assembly as in claim 3, wherein said unitary frame member is injection molded and said gasket material is co-injected with said upper frame member.

5. The shelf assembly as in claim 3, wherein said gasket material is pre-applied to said top surface of said pane.

6. The shelf assembly as in claim 1, further comprising a reinforcing rib extending between said upper frame member and said lower frame members outward of said edges of said shelf pane.

7. The shelf assembly as in claim 1, wherein said attachment mechanism comprises interlocking male and female members.

8. The shelf assembly as in claim 7, wherein said male member comprises a tab extending from an underside of said upper frame member, and said female member comprises a slot defined in said lower frame members, said tab extending through said slot and capped so as not to pull out of said slot.

9. The shelf assembly as in claim 8, wherein said tabs define locating shoulders against which said edges of said shelf pane engage.

10. The shelf assembly as in claim 1, wherein said shelf assembly is a pull-out shelf assembly, said upper frame member and a respective said lower frame member defining a downwardly curved pull-out handle along a front edge of said shelf pane.

11. The shelf assembly as in claim 1, wherein said shelf assembly is a pull-out shelf assembly, said lower frame members defining a slide surface outward of said edges of said shelf pane.

12. A pull-out refrigeration appliance shelf assembly, comprising:

a shelf pane having a perimeter defined by side edges, a front edge, and a back edge;

a single piece frame structure fitted around said perimeter of said shelf pane;

said frame structure further comprising:

a unitary upper frame member in which said shelf pane is seated, said upper frame member comprising a flange portion that extends inwardly from said edges along a top surface of said shelf pane;

shoulders extending from an underside of said upper frame member, said shoulders defining stops against which said edges of said shelf pane engage to position said shelf pane within said upper frame member;

a plurality of lower frame members, each lower frame member of said lower frame members pivotally connected to said upper frame member with a living hinge at a respective one of the side edges, the front edge or the back edge of said shelf pane such that the side edges, the front edge and the back edge of said shelf pane each have at least one of said plurality of lower frame members positioned thereat, said lower frame members folded under said upper frame member around said edges of said shelf pane and extending inwardly along a bottom surface of said shelf pane; and said lower frame members fastened to said upper frame member outward of said edges of said shelf pane.

13. The pull-out refrigeration appliance shelf assembly as in claim 12, further comprising a gasket material configured on an underside of said flange portion of said upper frame member that seals against said top surface of said shelf pane.

14. The pull-out refrigeration appliance shelf assembly as in claim 13, wherein said unitary frame member is injection molded and said gasket material is co-injected with said upper frame member.

15. The pull-out refrigeration appliance shelf assembly as in claim 12, wherein said lower frame members are attached to said shoulders to secure said lower frame members to said upper frame member.

16. The pull-out refrigeration appliance shelf assembly as in claim 15, wherein said shoulders comprise downwardly extending tabs that engage through slots defined in said lower frame members, said tabs capped so as not to pull out of said slots.

17. The pull-out refrigeration appliance shelf assembly as in claim 12, wherein said upper frame member and a respective said lower frame member define a downwardly curved pull-out handle along said front edge of said shelf pane.

18. The pull-out refrigeration appliance shelf assembly as in claim 12, wherein said lower frame members along said side edges of said shelf pane define a slide surface outward of said side edges of said shelf pane.

* * * * *